United States Patent [19]

Gorchev et al.

[11] 4,295,416

[45] Oct. 20, 1981

[54] AIR DISTRIBUTION SYSTEM

[75] Inventors: Dimiter Gorchev, Boston, Mass.; Karl U. Ingard, Kittery Point, Me.; Herbert L. Willke, Jr., Cambridge, Mass.

[73] Assignee: Mitco Corporation, Somerville, Mass.

[21] Appl. No.: 944,134

[22] Filed: Sep. 20, 1978

[51] Int. Cl.[3] ..... F24F 13/00

[52] U.S. Cl. ..... 98/33 R; 98/38 D; 98/DIG. 10; 181/224

[58] Field of Search ..... 98/38 R, 38 D, 32, 33 R, 98/33 A, DIG. 10, 35, 408, 41; 181/224, 218, 282, 239; 406/181

[56] References Cited

U.S. PATENT DOCUMENTS

| | | | |
|---|---|---|---|
| 209,506 | 10/1878 | Owens | 98/35 |
| 2,295,251 | 6/1940 | Baker | 98/38 |
| 3,642,093 | 2/1972 | Schach | 98/41 X |
| 3,748,997 | 7/1973 | Dean, Jr. et al. | 98/33 R |
| 3,802,327 | 4/1974 | Otsuka | 98/32 |
| 4,132,159 | 1/1979 | Dellrud et al. | 98/32 X |

FOREIGN PATENT DOCUMENTS

| | | | |
|---|---|---|---|
| 715865 | 8/1965 | Canada | 181/224 |
| 444206 | 3/1936 | United Kingdom | 181/224 |
| 1198549 | 7/1970 | United Kingdom | 181/224 |

*Primary Examiner*—Albert J. Makay
*Assistant Examiner*—Henry Bennett
*Attorney, Agent, or Firm*—Kenway & Jenney

[57] ABSTRACT

An air distribution system for a building including a mixing plenum for receiving and mixing outside and return air. An input flow concentrator and integral silencer is disposed within and coupled to the mixing plenum. The flow concentrator and integral silencer is adapted to establish a substantially axially symmetrical flow path for air from the plenum to an output port. A fan is coupled to the output port to drive the air from the output port to the main duct for distribution throughout the building.

19 Claims, 7 Drawing Figures

AIR DISTRIBUTION SYSTEM

REFERENCE TO RELATED APPLICATION

This application is related to U.S. patent application entitled "Branch Take-Off And Silencer For An Air Distribution System", filed on the same date as the present application, now U.S. Pat. No. 4,182,430. The related application is incorporated by reference herein.

BACKGROUND OF THE DISCLOSURE

The field of this invention is air distribution systems, and more particularly air handling units for air distribution systems for multiple story buildings.

Conventional air distribution systems for buildings typically include an air handling unit having discrete functional elements coupled together in series at a central location in the building. By way of example, such a unit might include an input plenum for mixing outside and return air, a filter bank, a conditioner unit (for heating and cooling), an airflow silencer, a fan and an output silencer, Generally, the various units are provided with rectangular cross-section geometry and outer packaging.

In multiple story building applications, a horizontal interconnection of all of these discrete elements typically requires relatively large space on a floor, and also requires a high velocity (and hence lossy) elbow interconnection between the output silencer and the vertical main distribution duct of the system. For air handling units having vertical interconnection of the discrete elements, a multiple story housing is typically required.

In addition to the relatively large space requirements for conventional systems, the various units impose severe floor loading constraints. There are also restrictive fan power constraints (due to relatively high losses in the silencers and through elbow connections). The serial combination of elements, interspersed with conventional silencers, requires several high-to-low and low-to-high air velocity changes. Such configurations have relatively high energy requirements for achieving the velocity control. Furthermore, the dispersed element configuration establishes a correspondingly dispersed source of noise, particularly in view of the generally rectangular geometry typically used for the various elements. In addition, each of the elements provide acoustical paths for transmission of noise to the rest of the building.

In typical applications, the conventional systems may be roof mounted, with each of the series-connected units having relatively large rectangular cross-section enclosures, and separate access doors for servicing. In severe weather environments, such systems are difficult to service, due to the number of separate elements which must be accessed, and the relatively large area in which the elements are dispersed.

It is an object of the present invention to provide an energy efficient air handling unit.

Another object is to provide a space efficient air handling unit.

Still another object is to provide an air distribution system with improved silencing characteristics.

SUMMARY OF THE INVENTION

Briefly, the present invention is directed to an air distribution system for a building. The system includes a mixing plenum for receiving and mixing outside and return air. An input flow concentrator and integral silencer is disposed within and coupled to the mixing plenum. The flow concentrator and integral silencer is adapted to establish a substantially axially symmetrical flow path for air from the plenum to an output port. A fan is coupled to the output port to drive the air from the output port to the main duct for distribution throughout the building.

In one form of the invention, the input flow concentrator and silencer includes inner and outer sections which are coaxial about a central axis. The outer section has a substantially conical inner surface which is disposed about the substantially conical outer surface of the inner section. In alternative embodiments, the inner and outer sections may be generally similar in shape but have polygonal cross-sections. The polygonal cross-section forms of the invention are considered to be axially symmetrical in the description below.

The flow concentrator and silencer has a substantially annular input port and an output port. The mean radius of the output port is less than that of the input port. To provide this configuration, the inner and outer sections are mutually separated so that their opposing surfaces define a flow path characterized by a substantially annular cross-section (with either circular, or elliptical or polygonal boundaries) which is coaxial with the central axis. The flow path has a decreasing mean radius from the annular input port to the output port.

In these forms of the invention, the flow concentrator includes an integral silencer. The silencer is provided by the inner and outer sections which have acoustically absorbent material forming their opposing surfaces. In accordance with the invention, further silencing may be provided by silencers distributed throughout the building. In some forms, the silencers may be conventional in-line silencers positioned in various branch ducts. In other forms, combination branch take-off/silencers may be utilized in the form described in the incorporated reference.

Generally, the combination branch take-off and silencer apparatus couples a main supply (input) duct to one or more branch ducts and to a coaxial output duct having a similar but smaller cross-section than the input duct. In this configuration, coaxial extensions of the input and output ducts define a shell region. The shell region is closed at its downstream end and open at its upstream end to oncoming air in the input duct. The shell region is divided at that upstream end by porous acoustical material into a plurality of adjacent channels which lead to a plenum near the downstream end of the shell region. The plenum is coupled to the branch ducts. With this configuration, air is tapped from the input duct, and that air flows along the shell region to the plenum. In the plenum, the tapped air is driven into the branch duct by either static or velocity pressure, depending on the particular geometry of the take-off/silencer. The remaining airflow in the input duct continues along into the output duct.

In accordance with the present invention, the air handling unit may be relatively compact compared with the prior art systems providing similar airflow characteristics. The input concentrator/silencer and distributed silencers provide a high degree of noise reduction (partly due to the compact arrangement of the central air handling unit, and partly due to the axial symmetry of the air handling unit) yet are relatively efficient in terms of energy consumption.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
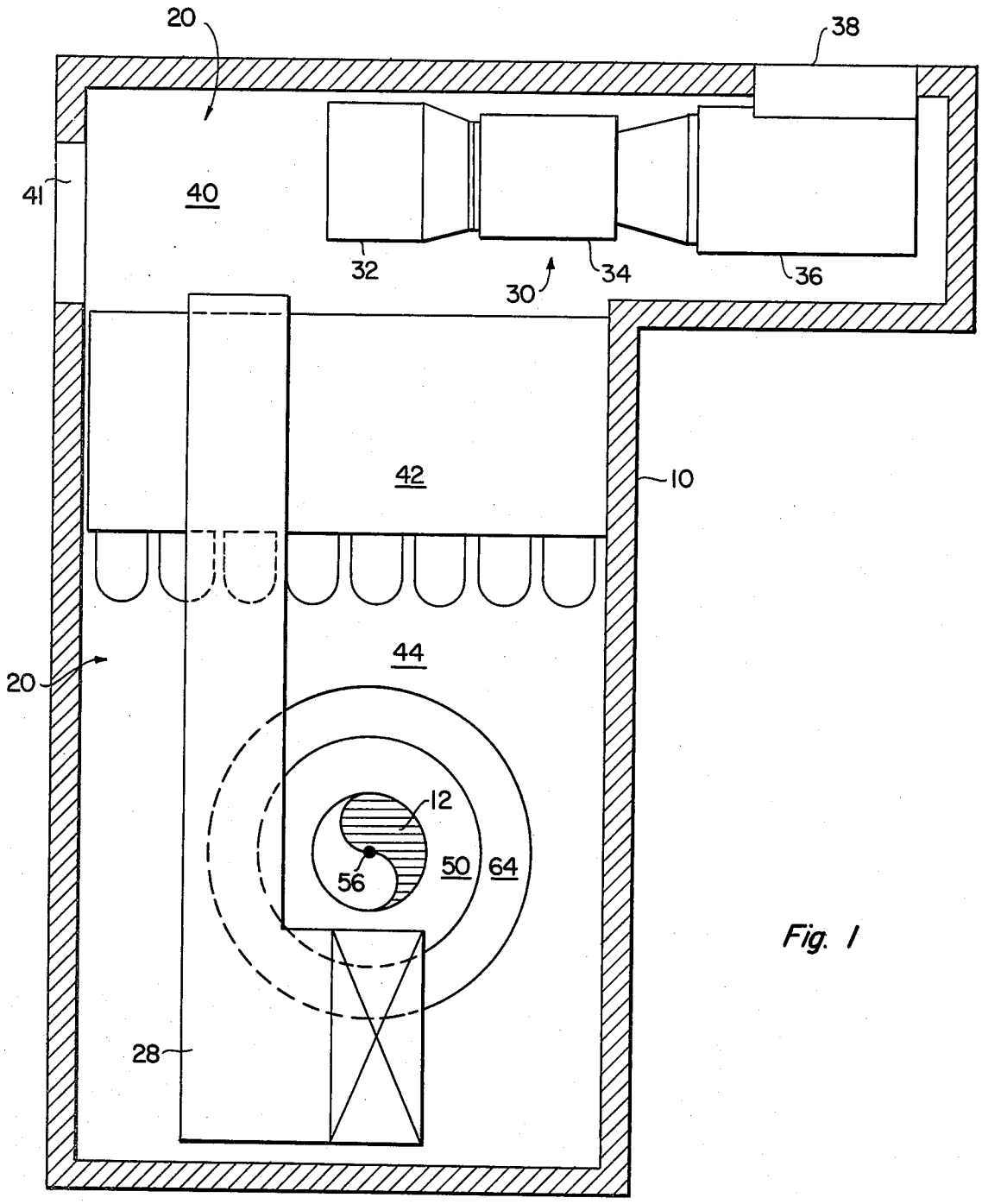
FIG. 1 shows a top view of an air handling unit in accordance with the present invention.
Figure 2:
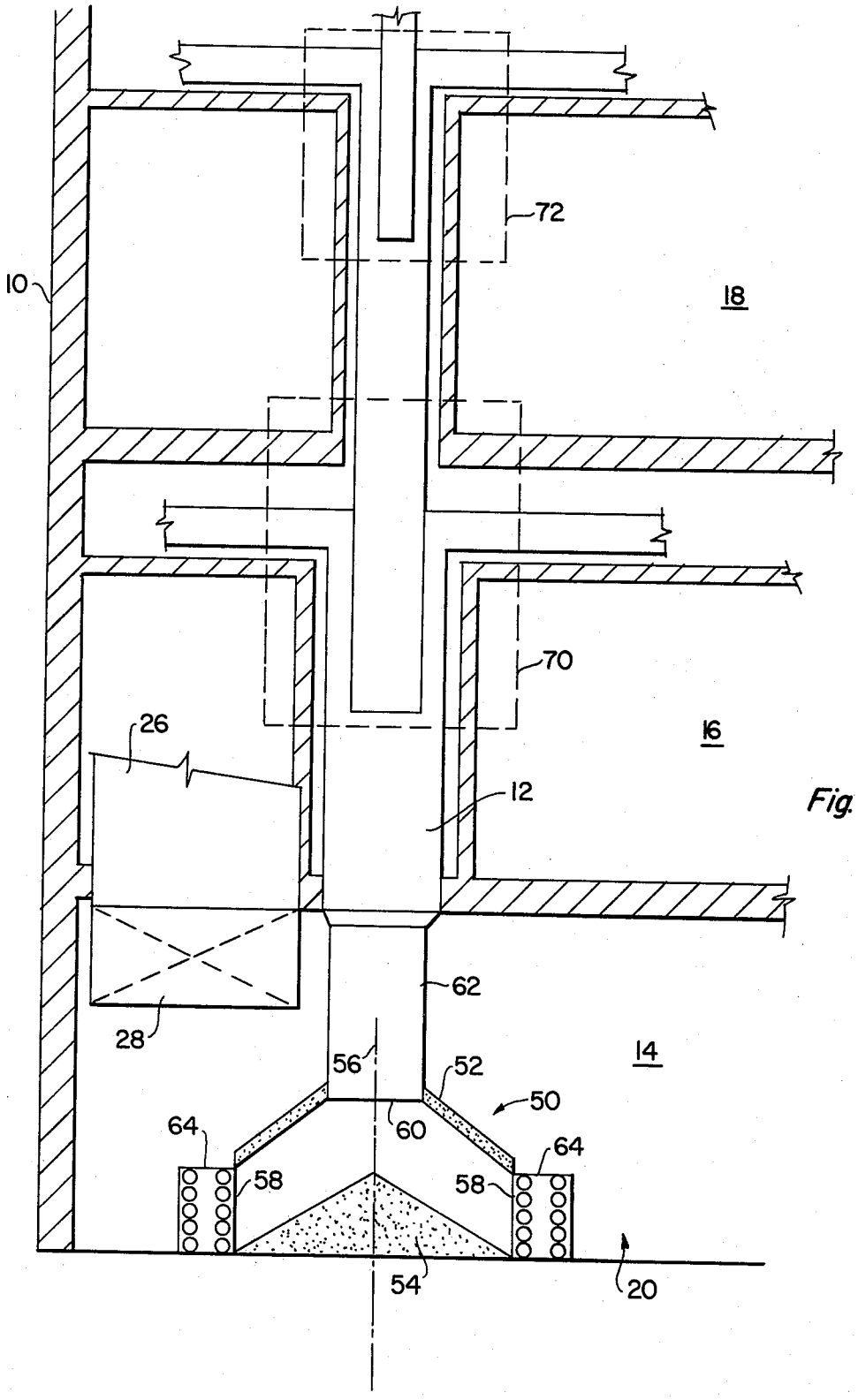
FIG. 2 shows a side view of an air distribution system including the unit of FIG. 1, as installed in a multiple story building.

FIGS. 1 and 2 shown an exemplary embodiment of the present invention. A multiple story building 10 is shown with a centrally located main air duct 12 vertically positioned in the core of the building. As shown, the building 10 includes a basement 14, a first floor 16 and a second floor 18. Additional floors may extend in a similar fashion. The basement 14 includes an enclosed chamber 20 which houses the principal elements for the air distribution system of building 10.

The air distribution system includes a conventional back draft exhaust assembly 30 including a silencer 32, axivane fan 34, back draft damper 36 and automatic adjustable louvre 38 coupled to the outside of the building.

In this configuration, the chamber 20 serves as the mixing plenum for outside air and return air. Return air is ducted in a conventional fashion through a silencer 26 and return duct 28 to the region 40 of chamber 20. In that region, air from the outside is drawn in through louvre 41 and joined with the return air. This mixture of outside and return air is then passed through a filter bank 42 to the region 44 within chamber 20. Both the chambers 40 and 44 function as the mixing plenum in the present embodiment.

The air distribution system further includes an air handling unit having input flow concentrator and integral silencer 50 and fan 51 positioned within the chamber 44. The concentrator/silencer 50 includes an outer section 52 and an inner section 54, with both sections being substantially axially symmetrical about a vertical axis 56. Concentrator/silencer 50 includes an input port 58 which extends symmetrically about the axis 56, and an output port 60. The outer section 52 is hollow and has a substantially conical inner surface. The inner section 54 has a substantially conical outer surface. The outer section 52 and inner section 54 are positioned so that their respective inner and outer surfaces establish a substantially axially symmetrical airflow path from the plenum provided by region 44, through the input port 58 to the output port 60.

In the present embodiment, the outer and inner sections 52 and 54 are lined with an acoustically absorbing material. With the present configuration, the flow path provided by concentrator/silencer 50 is characterized by a mean radius at input port 58 which is greater than the mean radius at the output port 60.

In the illustrated embodiment, cross-sections of the flow path defined by sections 52 and 54 are bounded by circles. In alternative embodiments, the sections 52 and 54 may be configured so that cross-sections of the flow path provided by those elements have boundaries which are elliptical, or alternatively polygonal. In such embodiments, although the inner and outer surfaces of elements 52 and 54, respectively, are not strictly speaking conical, for the present invention, such surfaces are effectively conical and are intended to be embraced within the meaning of the claims of this application.

An axivane fan 52 and associated ducting are coupled between the output port 60 of concentrator/silencer 50 and the main duct 12. In the present embodiment, a bank of heat exchange coils 64 is disposed adjacent to the input port 58. These coils may be conventional elements adapted to fit the particular dimensions of port 58, and may be used to conventionally condition (i.e. heat or cool) the air entering input port 58. In alternative embodiments, the filter bank 42 may take the form of filter elements mounted directly on the outer surfaces of the heat exchange coil bank 62.

Figure 3:
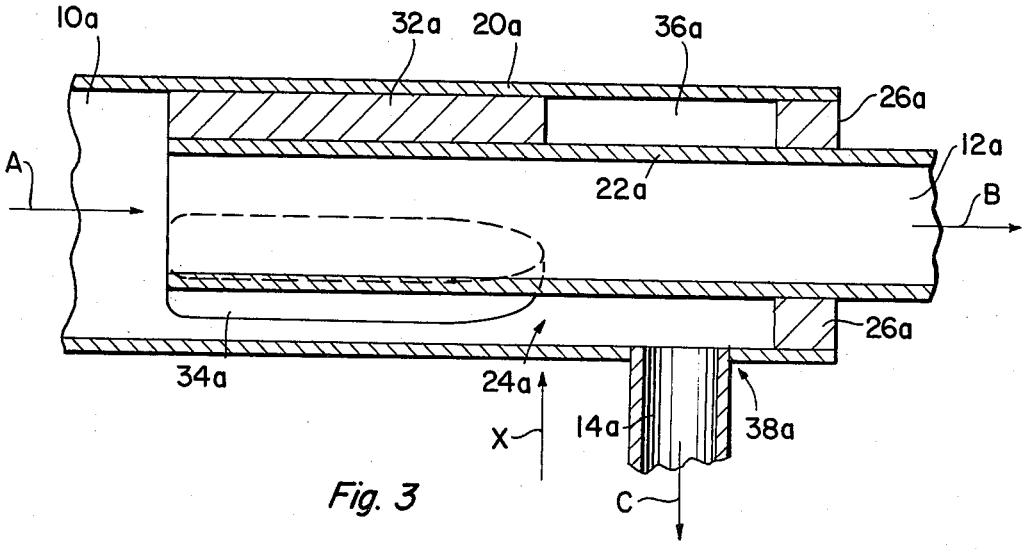
FIG. 3 shows an exemplary branch take-off and silencer for use in the system of FIG. 2 in accordance with the present invention.

The present embodiment includes a combination branch take-off and silencer 70 for the first floor 16 and a similar branch take-off and silencer 72 with the second floor 18 for supplying conditioned air from duct 12. In this embodiment, the branch take-off/silencers 70 and 72 are substantially of the form shown in the incorporated reference, with an exemplary form of one of those branch take-off and silencers shown in FIG. 3 of this application. In that figure, the reference designations include a designation "a" but otherwise are the same as those used in the incorporated reference.

In alternative forms of the invention, conventional static pressure operated, single function branch take-off elements may be used together with a conventional silencer in the various branch ducts. In both of the above configurations, the distributed silencers throughout the building provide a substantial lessening of the noise.

Figure 4:
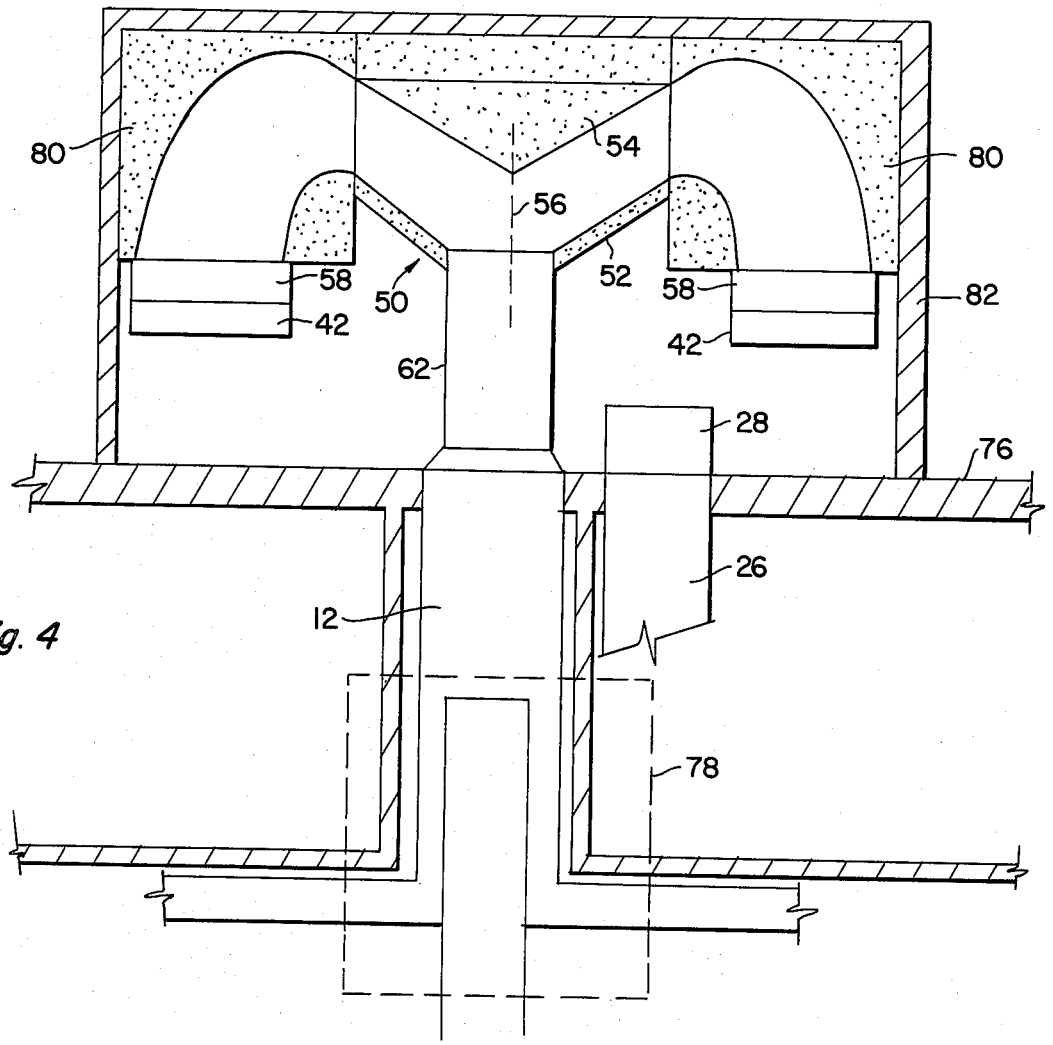
FIG. 4 shows an alternative form of the air distribution system of FIG. 2.

FIG. 4 shows an alternative configuration in accordance with the present invention, which is substantially similar to that shown in FIGS. 1 and 2 but wherein the air handling unit is mounted on roof 76 of the building and the main duct 12 extends downward to a branch take-off and silencer 78. In FIG. 4, the elements corresponding to elements in FIGS. 1 and 2 are denoted with identical reference numerals.

In FIG. 4, the flow concentrator 50 includes an inverting section 80 in addition to the other elements shown in the configurtion of FIGS. 1 and 2. The mixing plenum is established by a generally cylindrical housing 82. With this configuration, a compact roof mounted unit is provided with the inverting section 80 arranged to efficiently feed the return and outside air to the input port 58 of concentrator/silencer 50. Additional elements may also be housed within the single housing 82, such as heating and condensing cells and other alternative elements conventionally requiring separate enclosures. Thus, a single access may be utilized to service the entire air handling unit. This form of the invention is particularly useful in applications in extreme environments.

Figure 5:
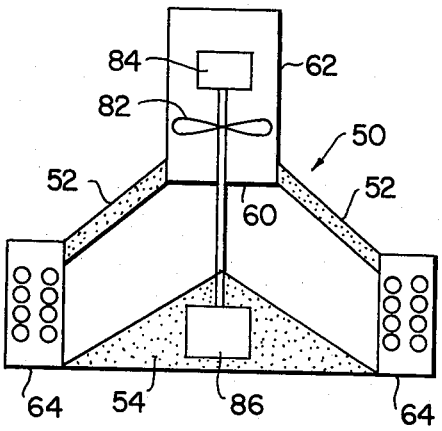
FIGS. 5 and 6 show alternative exemplary flow concentrator, silencer and fan configurations for use in the system of FIG. 2.

FIG. 5 shows an alternative form for the input concentrator/silencer 50, fan 62 and heat exchange bank 64, where the fan 50 is an axivane fan having a blade assembly (indicated schematically by blade 82) which may be selectively controlled to drive from either of motors 84 (which is in a conventional configuration for an axivane fan with the motor in the same housing with the fan blade) or a separate motor 86 coupled at the other end of the drive shaft 88. In this configuration, energy efficiency of the system may be enhanced by selectively operating either of motors 86 and 88, depending on the demands on the air distribution system.

Figure 6:
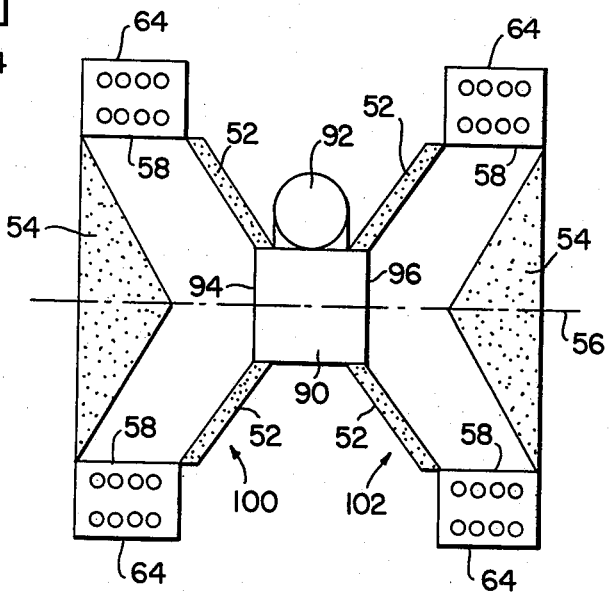

FIG. 6 illustrates in schematic form, an alternative form for the input concentrator/silencer and fan assembly and the heat exchanger bank. In this form, a centrifugal fan 90 of conventional form is shown with output port 92 for coupling to the main duct 12. Input ports for the fan 90 are shown by reference designations 94 and 96. With this conventional fan, two input flow concentrators/silencers 100 and 102 are shown coupled to the input ports 94 and 96, respectively, of fan 90. Both concentrators/silencers 100 and 102 may be substantially the same form as that shown in FIGS. 1 and 2 for input concentrator/silencer 50. In FIG. 6, elements of concentrator/silencers 100 and 102 which correspond to similar elements of the concentrator/silencer 50 and heat exchanger bank 64 in FIG. 2 are denoted by identical reference numerals.

Figure 7:
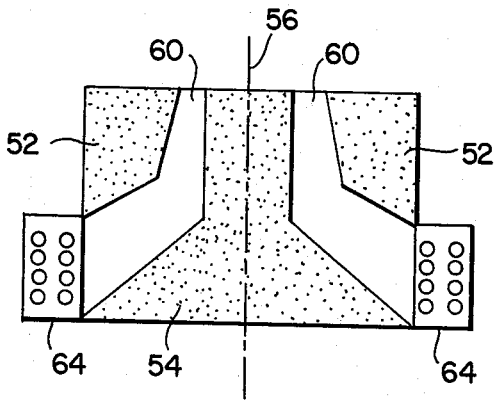
FIG. 7 shows in cross-section, an alternative flow concentrator for use in the system of FIG. 2.

FIG. 7 shows a cross-section of an alternative form for the input concentrator/silencer 50 and heat exchanger bank 64 of the embodiment of FIGS. 1 and 2. Elements of FIG. 7 similar to elements in FIG. 2 are denoted by similar reference numerals. In FIG. 7, the outer and inner sections 52 and 54 include two stage surfaces. Although the upper portion of the outer surface of inner section 54 is substantially cylindrical as shown in FIG. 7, the overall effect of that outer surface (i.e. including the lower portion of that surface) is to provide a substantially conical surface. Furthermore, the overall flow path defined by the inner and outer surfaces of elements 54 and 52, respectively, in FIG. 7 is still an axially symmetrical airflow path from the input port 58 to the output port 60.

The invention may be embodied in other specific forms without departing from the spirit or essential characteristics thereof. The present embodiments are therefore to be considered in all respects as illustrative and not restrictive, the scope of the invention being indicated by the appended claims rather than be the foregoing description, and all changes which come within the meaning and range of equivalency of the claims are therefore intended to be embraced therein.

We claim:

1. An air distribution system comprising, in combination:

A. a mixing plenum including means for receiving outside and return air,

B. input flow concentrator and integral silencer disposed within said plenum, said concentrator and silencer including a concentrator input port coupled to said plenum and sidewalls establishing an airflow path from said concentrator input port to an output port, said airflow path being substantially symmetrical about an output axis, said sidewalls including inner and outer path defining surfaces lined with acoustically absorbent material, said inner and outer path defining surfaces defining a substantially radial airflow path adjacent to said plenum and a substantially axial airflow path at said output port, said inner path defining surface being substantially symmetrical about said output axis and extending along said output axis substantially across said concentrator input port, wherein said concentrator and silencer include inner and outer sections coaxial with said airflow axis, said outer section being hollow and having an inner surface and said inner section having an outer surface, said inner section having an outer surface, said inner and outer surface being mutually separated to form said path defining surfaces.

C. a fan having a fan input port coupled to said output port.

2. A system according to claim 1 wherein said flow path is characterized by a mean radius at the point coupling said plenum which is greater than the mean radius at said output port.

3. A system according to claim 2 wherein the boundaries of cross-sections of said flowpath defined by said inner and outer surfaces are circular.

4. A system according to claim 2 wherein the boundaries of cross-sections of said flowpath defined by said inner and outer surfaces are elliptical.

5. A system according to claim 3 wherein the boundaries of cross-sections of said flowpath defined by said inner and outer surfaces are polygonal.

6. A system according to claim 1 wherein said fan is a centrifugal fan.

7. A system according to claim 6 wherein said centrifugal fan includes two input ports and wherein said flow concentrator and silencer includes a pair of means for establishing substantially axially symmetrical airflow paths from said plenum to an associated output port, and wherein each of said output ports is coupled to an associated input port of said fan, wherein each of said path establishing means include path defining surfaces lined with acoustically absorbent material.

8. A system according to claim 7 wherein each of said concentrators and silencer include inner and outer sections coaxial with said airflow axis, said outer section being hollow and having a substantially conical inner surface and said inner section having a substantially conical outer surface, said inner and outer surfaces being mutually separated to form said path defining surfaces.

9. A system according to claim 7 wherein said pair of means are disposed on opposite side of said fan.

10. A system according to claim 1 wherein said fan is an axial fan having an input and output port, said fan input port being coupled to said output port of said flow concentrator means.

11. A system according to claim 10 wherein said concentrator and silencer include inner and outer sections coaxial with said airflow axis, said outer section being hollow and having a substantially conical inner surface and said inner section having a substantially conical outer surface, said inner and outer surfaces being mutually seprated to form said path defining surfaces.

12. A system according to claim 10 wherein each end of the drive shaft for said axial fan is coupled to a separate driving motor, said motors being characterized by different output speeds, and wherein said system further includes a control to selectively control said motors whereby only one is operative at a time.

13. A system according to claim 1 wherein said system further includes at least one silencer and branch take-off coupled to the output port of said fan.

14. A system according to claim 13 wherein said branch take-off and silencer comprises an apparatus for coupling an airstream from an input duct leading from said fan output port to an output duct and one or more branch ducts, said input and output ducts having a common central axis and similar cross-sectional shapes at the ends to be coupled and said input duct having a larger cross-sectional area than said output duct, and said branch ducts having branch axes at the end to be coupled to said input duct, said branch axes being angularly offset from said common central axis, said apparatus comprising:

A. an outer section having a cross-section substantially the same as the cross-section of said input duct, said outer section having a central axis coaxial with said common axis and said outer section being coupled at one end to said end of said input duct, B. an inner section having a cross-section substantially the same as the cross-section of said output duct, said inner section having a central axis coaxial with said common axis, and said inner section being coupled at one end to said end of said output duct and extending into said outer section to define a shell region between said inner and outer sections, C. a plug means for sealing the end of said shell region adjacent to said output duct, D. channel means for establishing a plurality of channels in said shell region, said channels extending from a point near the end of said shell region adjacent to said input duct to an intermedite point within said shell region, whereby the portion of said shell region between said intermediate point and said plug means forms a common plenum, E. branch coupling means for coupling said plenum to said branch ducts.

15. A system according to claim 1 wherein said system includes a main duct coupled to said fan and a plurality of branch ducts, each of said branch ducts including means to tap a portion of the airstream from one of the ducts from the set of ducts including said main duct and said branch ducts, wherein the remainder of said airstream in the tapped duct passes to an output duct, further comprising:

distributed means for attenuating noise in one or more of said branch ducts, said distributed means including silencing means associated with each of said branch ducts, each of said silencing means being located at or near the junction of said associated branch duct with the tapped duct..

16. A system according to claim 15 wherein at least one of said tap means and said silencing means includes apparatus for coupling said airstream from said tapped duct to an input duct and channelling said tapped air to one or more branch ducts, wherein the remainder of the airstream in said tapped duct passes to an output duct, said input and output ducts have a common central axis and similar cross-sectional shapes at the ends to be coupled and said input duct having a larger cross-sectional area than said output duct, and said branch ducts having branch axes at the end to be coupled to said input duct, said branch axes being angularly offset from said common central axis, said apparatus comprising:

A. an outer section having a cross-section substantially the same as the cross-section of said input duct, said outer section having a central axis coaxial with said common axis and said outer section being coupled at one end to said end of said input duct, B. an inner section having a cross-section substantially the same as the cross-section of said output duct, said inner section having a central axis coaxial with said common axis, and said inner section being coupled at one end to said end of said output duct and extending into said outer section to define a shell region between said inner and outer sections, C. a plug means for sealing the end of said shell region adjacent to said output duct, D. channel means for establishing a plurality of channels in said shell regions, said channels extending from a point near the end of said shell region adjacent to said input duct to an intermediate point within said shell region, whereby the portion of said shell region between said intermediate point and said plug means forms a common plenum, E. branch coupling means for coupling said plenum to said branch ducts.

17. A system according to claim 13 wherein said branch take-off and silencer comprises apparatus for coupling an airstream from an end of an input duct leading from said fan output port to an end of an output duct and at least one branch duct, said apparatus comprising:

A. an inner section having a cross-section substantially the same as the cross-section of the upstream end of said output duct, said inner section being adapted for coupling at one end to said upstream end of said output duct, B. an outer section disposed about at least a portion of said inner section and defining a shell region between said inner section portion and said outer section, C. channel means for establishing at least one channel in said shell region, said channel extending from a point near the end of said shell region adjacent to said input duct to the upstream end of said branch duct, D. branch coupling means for coupling said channel to said upstream end of said branch duct.

18. A system according to claim 15 wherein at least one of said tap means and said silencing means includes apparatus for coupling said airstream from said tapped duct to an input duct and channelling said tapped air to one or more branch ducts, wherein the remainder of the airstream in said tapped duct passes to an output duct, said apparatus comprising:

A. an inner section having a cross-section substantially the same as the cross-section of the upstream end of said output duct, said inner section being adapted for coupling at one end to said upstream end of said output duct, B. an outer section disposed about at least a portion of said inner section and defining a shell region between said inner section portionand said outer section, C. channel means for establishing at least one channel in said shell region, said channel extending from a point near the end of said shell region adjacent to said input duct to the upstream end of said branch duct, D. branch coupling means for coupling said channel to said upstream end of said branch duct.

19. A system according to claim 1 wherein said outer section having a substantially conical inner surface and said inner section having a substantially conical outer surface.

* * * * *

US004295416B1

REEXAMINATION CERTIFICATE (2693th)

United States Patent [19]

Gorchev et al.

[11] B1 4,295,416

[45] Certificate Issued Oct. 17, 1995

[54] AIR DISTRIBUTION SYSTEM

[75] Inventors: Dimiter Gorchev, Boston, Mass.; Karl U. Ingard, Kittery Point, Me.; Herbert L. Willke, Jr., Cambridge, Mass.

[73] Assignee: Mitco Corp., Somerville, Mass.

Reexamination Request
No. 90/003,501, Jul. 18, 1994

Reexamination Certificate for:

| | |
|---|---|
| Patent No.: | **4,295,416** |
| Issued: | **Oct. 20, 1981** |
| Appl. No.: | **944,134** |
| Filed: | **Sep. 20, 1978** |

[51] Int. Cl.[6] ..... F24F 13/00; F24F 13/24

[52] U.S. Cl. ..... 454/262; 181/224; 454/228; 454/236; 454/252; 454/906

[58] Field of Search ..... 181/218, 224, 181/239, 282; 454/228, 232, 233, 236, 261, 262, 906

[56] References Cited

U.S. PATENT DOCUMENTS

| | | |
|---|---|---|
| 209,506 | 10/1878 | Owens . |
| 319,074 | 6/1885 | Crompton . |
| 352,597 | 11/1886 | Wohlfert . |
| 1,916,908 | 7/1933 | Stacey, Jr. et al. . |
| 2,295,251 | 9/1942 | Baker . |
| 3,642,093 | 2/1972 | Schach . |
| 3,748,997 | 7/1973 | Dean, Jr. et al. . |
| 3,802,327 | 4/1974 | Otsuka . |
| 3,949,830 | 4/1976 | Muehlbauer et al. . |
| 3,960,063 | 6/1976 | Siemes et al. . |
| 4,132,159 | 1/1979 | Dellrud et al. . |

FOREIGN PATENT DOCUMENTS

| | | | |
|---|---|---|---|
| 715865 | 8/1965 | Canada | 181/224 |
| 444206 | 3/1936 | United Kingdom . | |
| 1198549 | 7/1970 | United Kingdom | 181/224 |

*Primary Examiner*—Harold Joyce

[57] ABSTRACT

An air distribution system for a building including a mixing plenum for receiving and mixing outside and return air. An input flow concentrator and integral silencer is disposed within and coupled to the mixing plenum. The flow concentrator and integral silencer is adapted to establish a substantially axially symmetrical flow path for air from the plenum to an output port. A fan is coupled to the output port to drive the air from the output port to the main duct for distribution throughout the building.

19 Claims

REEXAMINATION CERTIFICATE ISSUED UNDER 35 U.S.C. 307 NO AMENDMENTS HAVE BEEN MADE TO THE PATENT. +CM +P0 AS A RESULT OF

REEXAMINATION, IT HAS BEEN DETERMINED THAT:

The patentability of claims 1–19 is confirmed.

* * * * *